United States Patent [19]

Sullivan

[11] 3,938,114

[45] Feb. 10, 1976

[54] GAS-POWERED ALARM WITH PRESSURE RESPONSIVE REMOTE INDICATOR CIRCUIT

[75] Inventor: Joseph T. Sullivan, Huntingdon Valley, Pa.

[73] Assignee: Standard-Farrington Alarm & Signal Corporation, Trevose, Pa.

[22] Filed: Apr. 5, 1974

[21] Appl. No.: 458,062

[52] U.S. Cl. ..... 340/227.1; 116/5; 116/106; 340/240

[51] Int. Cl.[2] ..... G08B 17/02; G08B 17/04

[58] Field of Search ..... 116/103, 3, 5, 106; 340/227.1, 240

[56] References Cited

UNITED STATES PATENTS

| | | | |
|---|---|---|---|
| 3,014,206 | 12/1961 | Slavin | 340/227.1 |
| 3,109,409 | 11/1963 | Demay | 116/103 |
| 3,667,419 | 6/1972 | Sullivan | 116/106 |

*Primary Examiner*—Glen R. Swann, III
*Attorney, Agent, or Firm*—Paul & Paul

[57] ABSTRACT

The passage-way between a freon cylinder and a freon-powered horn is plugged by a eutectic metal plug. When sufficient heat loosens the plug, the horn is activated. A switch in the passageway senses the back pressure from the freon gas flow and activates a remote electrical indicator which can be used to determine which of a plurality of horns has been activated.

3 Claims, 3 Drawing Figures

GAS-POWERED ALARM WITH PRESSURE RESPONSIVE REMOTE INDICATOR CIRCUIT

BACKGROUND OF THE INVENTION

Many home and commercial fire alarm systems employ a design which is dependent upon remote sensors. Since the most practical method of transmitting information over any distance is through electrical means, most alarms of this type rely on batteries, house power, or a combination of the two. Most electronic sensing systems utilize a low voltage sensing circuit to provide information to a central control center. In very large installations, such as office buildings, motels, hospitals, and industrial complexes, an additional independent power source must be utilized if an alarm is to be sounded in the immediate vicinity of the triggered sensor. Consequently, the advantage of having a central control center is offset by the added expense of installing independently powered alarm systems to provide local as well as general alarms. Unfortunately, remote sensor electronic alarms are prone to a number of disabling problems. Battery powered units must be checked frequently and provide maximum security only immediately after recharge or replacement. Systems operating on house power are sensitive to power interruptions and units which incorporate both means are costly and seldom work interchangeably on the different power modes.

The other common type of alarm relies upon remote independent self-powered units which are usually triggered in the presence of excessive heat. Although these units may be powered by house power or battery, since there is no need to transmit information over great distances, physical means may be employed. One such method employs a freon containing cylinder connected to a freon horn through a heat sensing trigger. This type of system is fully described in U.S. Pat. No. 3,667,419. The best of these units may last up to 30 years without recharging. They have the advantage of complete independence from house power interruption and battery deterioration. Once they are triggered they provide a piercing local alarm which may continue until the area is evacuated.

Remote independently powered alarms are presently limited to applications where it is necessary to provide no more than a local alarm. In a large installation, such as a hotel, it is difficult for the proprietors to hear and establish the exact location of a triggered alarm. Furthermore, independently powered alarms are usually unable to perform tasks such as sounding a general alarm, or directly notifying the police and fire departments. As a result, these alarms have been restricted to installations where a piercing local alarm provides adequate protection.

SUMMARY OF THE INVENTION

The present invention provides a means of alarm protection which is neither dependent upon the vicissitudes of outside power nor restricted by the limitations of an independent power source system. This invention, which represents an improvement for use with the independently-powered alarm system patented by the applicant in U.S. Pat. No. 3,667,419, provides a freon powered alarm which has been modified to trigger remote sensing circuitry through the operation of freon discharge back pressure upon a pressue sensitive switch. Pre-existing freon units may be quickly converted to the system of the invention and existing installations may quickly be modified without causing any substantial interruption in local protection. The invention provides for a number of independently powered units which need no maintenance for an extended period of time, and a central indicator such as an alarm which will detect and locate excessive heat at any one of the units, while providing fail-safe operation in the event of black-out or control center malfunction.

DETAILED DESCRIPTION OF THE INVENTION

Figure 3:
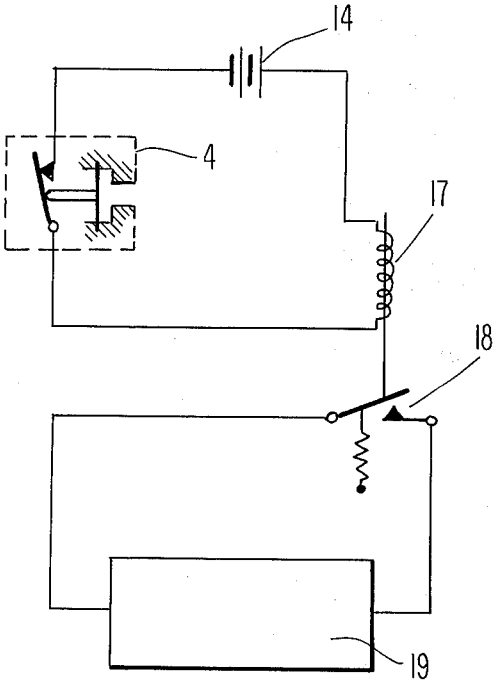
FIG. 3 shows a schematic circuit diagram for a circuit between a diagrammatically depicted remote unit and control center.

Although specific forms of the invention have been selected for illustration in the drawings, and the following description is drawn in specific terms for the purpose of describing these forms of the invention, this description is not intended to limit the scope of the invention which is defined in the appended claims.

Figure 1:
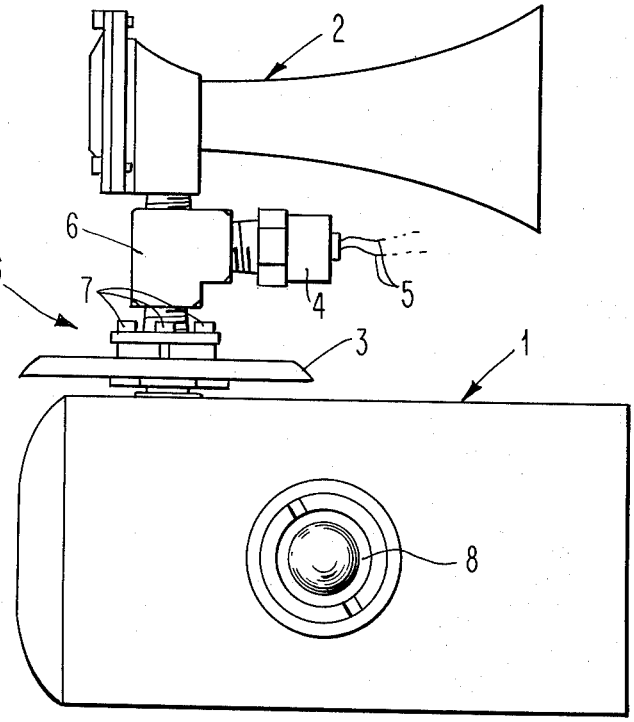
FIG. 1 shows the side view of the independent freon charged unit incorporating the invention.

FIG. 1 shows the completed remote unit consisting of the freon filled pressure cylinder designated generally 1, the gas powered alarm horn designated generally 2, and the means for triggering the alarm system. More specifically, FIG. 1 shows the heat sensing trigger designated generally 16 consisting of a sandwich of layers held together by screws 7. This heat sensing trigger is activated by contact of heated convection currents on the metal heat collector 3. An exterior side view is shown of the means for sensing the gas discharge by the remote sensing circuit comprising a pressure sensitive switch 4, leads to connect the switch to the sensing circuitry 5, and a threaded chamber 6 for the conversion of the discharge pressure to back pressure of sufficient magnitude to operate the switch 4, which in turn triggers the sensing circuit.

Figure 2:
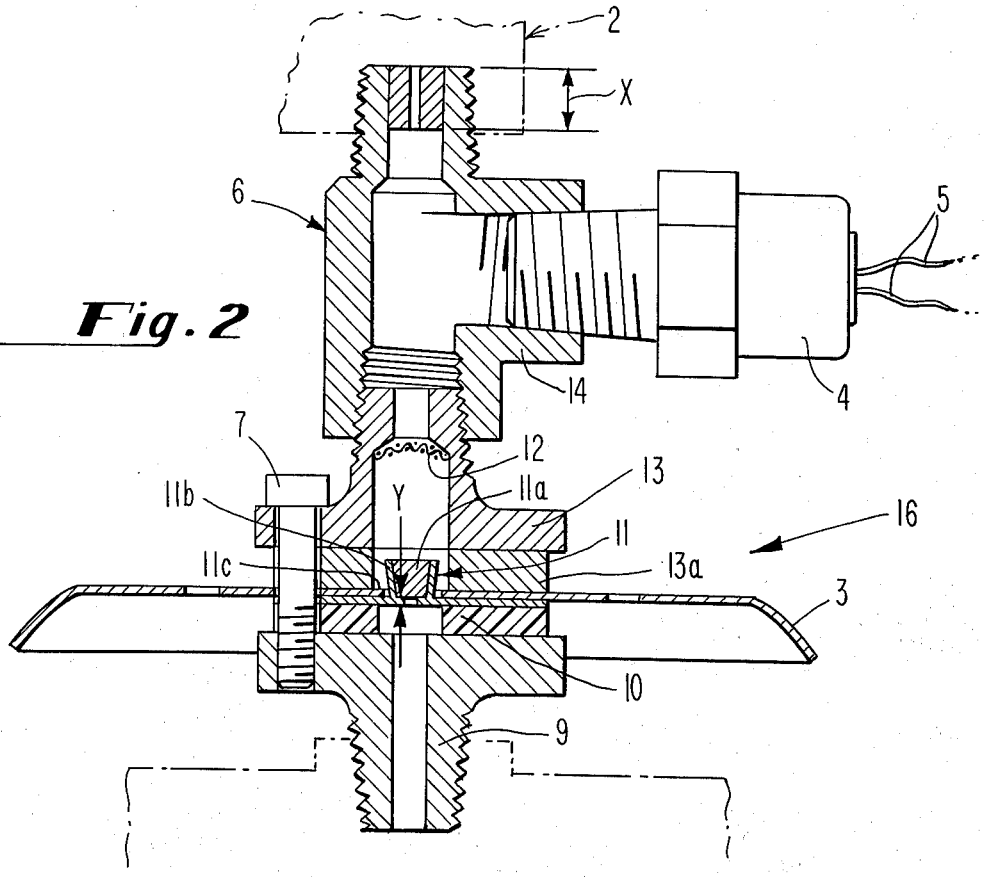
FIG. 2 shows an enlarged cross section of the discharge mechanism of the unit shown in FIG. 1.

FIG.2 is a detailed cross section of the heat sensing trigger designated generally 16 and pressure conversion means. The heat sensing trigger comprises a first threaded adaptor 9, heat collecting washer 10, activator 11, eutectic metal plug 11a, heat collector 3, spacer **13*a*, screen 12, a second threaded adaptor 13, and screws 7 which compressively engage all of the heat sensing trigger elements described above. The liquid freon containing cylinder designated generally 1 is shown connected to the heat sensing trigger by a threaded connection with first adaptor 9. First adaptor 9 contains a substantially cylindrical opening which is aligned with a larger substantially cylindrical recess in heat collecting washer 10. The activator designated generally 11 comprises a cup-shaped housing 11b filled with a eutectic metal plug 11*a* and a base 11*c* having a small aperture therein which functions to permit the gas pressure to reject the plug from the cup when heat collector 3 has warmed the activator to a predetermined temperature at which the bond between the eutectic metal and the activator disc cup walls weaken. In the preferred embodiment, the aperture in activator base 11c has a diameter of 0.035 inches and a bore length y of 0.020 inches. The fluid frictional resistance of this aperture is critical as it determines the force which is applied to the plug as well as the rate of gas flow from the cylinder to the pressure conversion means. Upon heat activation, the eutectic metal plug is blown from the cup against screen 12 which is located over a constriction in the substantially cylindrical passage extending through second adaptor 13. Screen 12 is positioned to prevent plug 11***a* from impeding gas flow through adaptor 13.

The pressure conversion means utilizes the freon gas flow resulting from activation of the heat sensing trigger. The pressure conversion means acts to create a back pressure which is sufficient to activate pressure sensitive switch 4 while simultaneously facilitating the passage of freon gas in sufficient quantity to sound air horn 2. In the preferred embodiment, the pressure conversion means comprises a chamber designated generally 6 which is threaded to attach to second adaptor 13. A recess within chamber 6 connects the substantially cylindrical opening in second adaptor 13 with air horn 2. This recess has a constricted portion at the end nearest the air horn so that a back pressure caused by the flow of freon gas will exert itself upon the interior surfaces of chamber 6. This constricted portion of the recess should exert a slightly greater fluid frictional resistance than that of the aperture described above. In the preferred embodiment, the constricted portion of the recess is a substantially cylindrical opening having a diameter of 0.031 inches and having a bore length $x$ of .375 inches. This opening is selected to facilitate sufficient gas flow to activate horn 2, while providing a reasonably constant and prolonged pressure upon the walls of the chamber during gas discharge. One reasonably skilled in the art may vary the bore length and cross sectional area of this constricted portion to compensate for the frictional characteristics encountered in the passage of the freon gas from the cylinder 1 to the air horn 2. In one embodiment, the cross sectional area of the constricted portion might even be larger than that of the aperture in the activator base 11*c* as long as the disparity in frictional resistances was maintained by a disparity in bore lengths $x$ and $y$. At least one of the surfaces of the unconstricted portion of the recess in chamber 6 is modified to sense the gas pressure exerted thereon. In the preferred embodiment, the modification of this surface is accomplished by inserting a pressure sensitive switch 4 into a threaded opening which is part of the unconstricted portion of the recess defined in chamber 6. In order to facilitate rapid build-up and detection of an increase in gas pressure within chamber 6, it is important to limit the total volume of the recess within chamber 6 so that the pressure sensitive switch 4 will be activated almost immediately upon activation of the heat sensing trigger 16.

FIG. 3 shows a representative alarm circuit incorporating pressure sensitive switch 4 and its connection to pressure chamber 6. Although FIG. 3 employs a sensing circuit in which the normal position of the switch is closed, a "single-pole double-throw" switch may be provided so that, with a slight circuit modification, a normally open sensing switch may also be employed. In the preferred embodiment, switch 4 is wired in a closed loop circuit where power source 14 energizes relay 17 to hold switch 18 in the open position. During gas release, an increase in pressure on the inner surfaces of chamber 6 forces open the switch 4, breaking the circuit and allowing switch 18 to close, thus activating an alarm or other signal device in the central indicator 19.

Use of normally closed switches and a single power source for many remote units provides a fail-safe feature for checking the operation of that power supply. Since each of the remote sensing devices are physically activated, it is virtually impossible for all of the sensing circuits to be activated simultaneously. Should all the indicators for the remote sensors energize simultaneously, it may safely be assumed that there has been a failure in power supply 14. This indicator, which is triggered by the closing of switch 18, may activate dialing equipment, connect to computerized sensing equipment, sound a simple alarm or generally act in any manner known to the art. In the preferred embodiment, the indicator pinpoints the location of the triggered device thereby allowing rapid deployment of fire-fighting apparatus.

It will be understood that various changes in the details, materials and arrangement of parts which have been herein described and illustrated in order to explain the nature of this invention may be made by those skilled in the art within the principle and scope of the invention as expressed in the following claims.

It will further be understood that the "Abstract of the Disclosure" set forth above is intended to provide a nonlegal technical statement of the contents of the disclosure in compliance with the Rules of Practice of the United States Patent Office, and is not intended to limit the scope of the invention described and claimed herein.

What is claimed:

1. In a temperature detection and alarm sounding apparatus for physically sounding an alarm at a predetermined alarm temperature comprising:

a. a cylinder containing freon under pressure;

b. a horn, activated by freon under pressure; and c. a temperature sensitive passage means, isolating said horn from said cylinder when the ambient temperature is below said alarm temperature, and providing a connecting passage between said horn and said cylinder when the ambient temperature attains said alarm temperature, the improvement wherein said passage means further comprises a pressure conversion means for increasing gas pressure within said passage means, and a pressure sensing means for detecting an increase in the gas pressure within said passage means, and wherein said pressure conversion means comprises a part of said connecting passage adjacent to said horn, said part comprising at least two portions, a first constricted portion located at the end of the part immediately adjacent to said horn, and a second unconstricted portion contiguously located to said first constricted portion, and wherein said pressure sensing means comprises at least one pressure sensitive interior surface of said second unconstricted portion, and wherein said pressure sensing means further comprises a pressure sensitive switch, and wherein said pressure sensing means further comprises an alarm circuit connected to the switch having means for activating remote indicating devices in response to the activation of said switch.

2. The invention of claim 1, wherein the first constricted portion of said pressure conversion means exerts a fluid frictional resistance which is slightly greater than the fluid frictional resistance exerted by the section of the connecting passage which does not include said pressure conversion means.

3. The invention of claim 2, wherein the constricted portion of said pressure conversion means is substantially cylindrical having a diameter of 0.031 inches and having a bore length of 0.375 inches, and wherein the smallest cross sectional area of the connecting passage section which does not include the pressure conversion means comprises a substantially cylindrical opening which is 0.035 inches in diameter and 0.020 inches in bore length.

* * * * *